United States Patent [19]

Goulish et al.

[11] 4,197,685

[45] Apr. 15, 1980

[54] PARTITION STRUT ASSEMBLY

[75] Inventors: Gabriel Goulish, Youngstown; C. Herbert Hage, Poland, both of Ohio

[73] Assignee: GF Business Equipment, Inc., Youngstown, Ohio

[21] Appl. No.: 927,160

[22] Filed: Jul. 24, 1978

[51] Int. Cl.[2] ..... E04H 3/00

[52] U.S. Cl. ..... 52/239; 52/36; 52/582; 248/188.7

[58] Field of Search ..... 52/239, 36, 582, 292; 248/188.7; 160/135, 351

[56] References Cited

U.S. PATENT DOCUMENTS

| | | | |
|---|---|---|---|
| 2,175,717 | 10/1939 | Kerr | 52/239 X |
| 3,049,197 | 8/1962 | Ludwig | 52/239 X |
| 3,213,580 | 10/1965 | Mark | 52/239 X |
| 3,834,093 | 9/1974 | Tacke et al. | 52/71 |
| 3,844,079 | 10/1974 | Karrip | 52/582 X |
| 3,889,315 | 6/1975 | Stouffer | 160/135 X |
| 3,987,836 | 10/1976 | LeMay | 160/135 X |
| 4,018,019 | 4/1977 | Raith et al. | 52/36 X |

*Primary Examiner*—J. Karl Bell

*Attorney, Agent, or Firm*—Emory L. Groff, Jr.

[57] ABSTRACT

A strut assembly for a partition system includes an angular strut having a slotted upright normally captively disposed within the interior of a housing by lock structure. Tool access to the lock structure from without the housing allows of selective attachment and removal of the assembly from a position adjacent a post of the partition system as well as vertical adjustment of the strut while the housing remains stationary relative the post. A single strut assembly may alternately be attached to a rectangular or round post. In the former instance the housing and lock structure directly engage the post while in the latter case an intermediate hanger member serves as a stationary base for the attachment of the housing and the locking of the selectively positioned strut.

12 Claims, 6 Drawing Figures

FIG. 1.
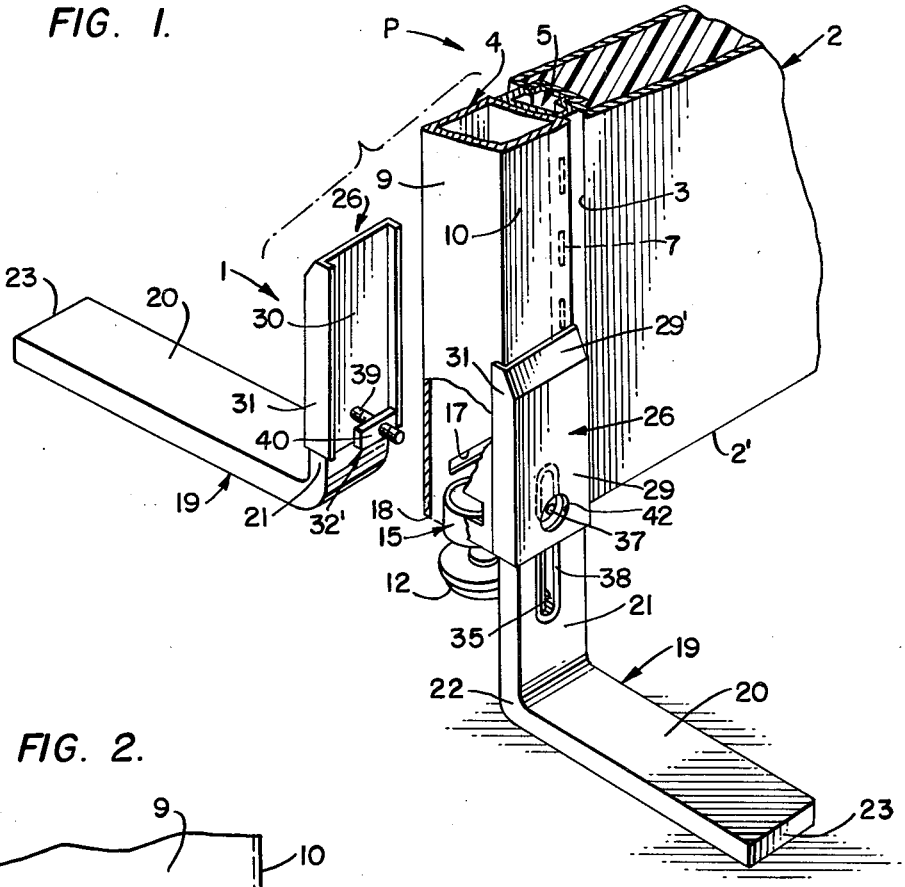
FIG. 2.
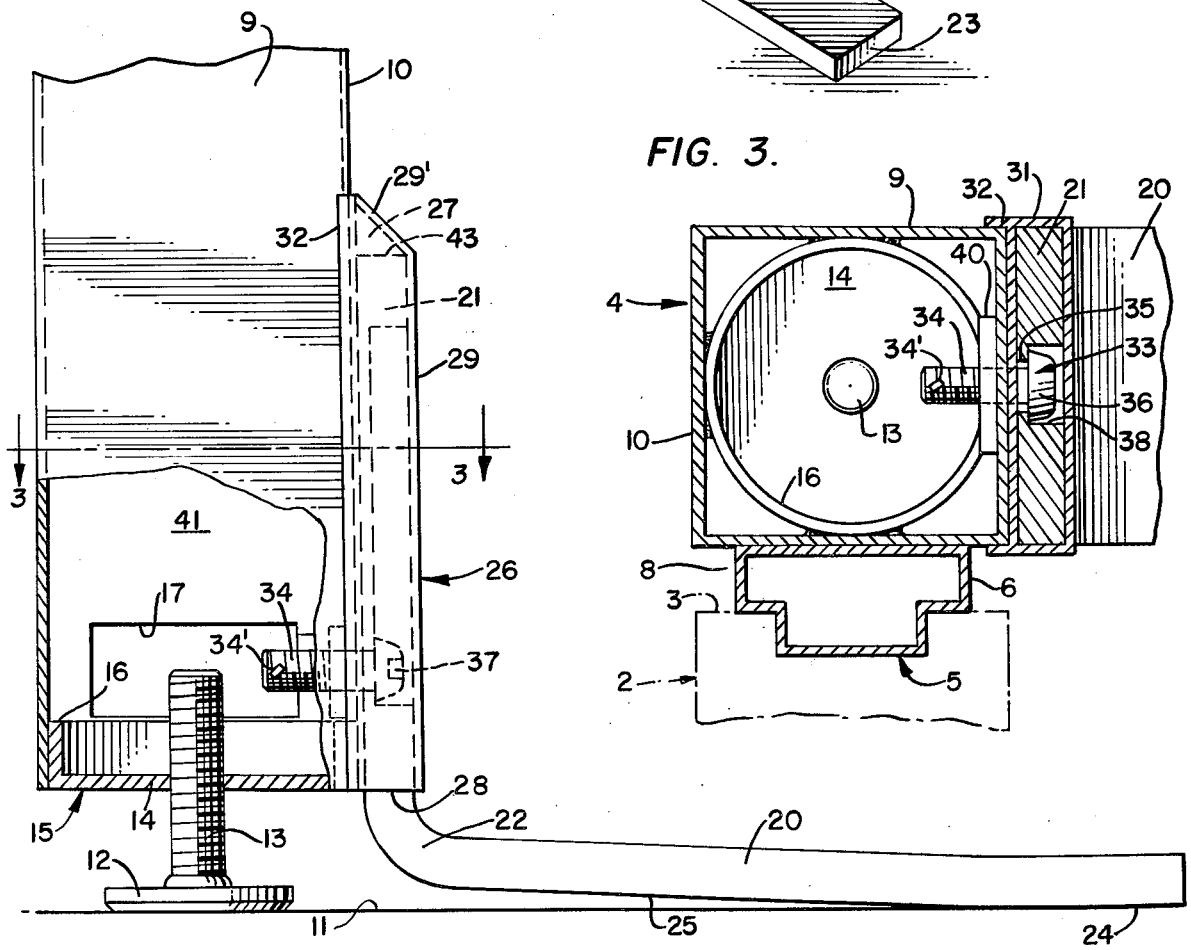
FIG. 3.

PARTITION STRUT ASSEMBLY

This invention relates generally to partition or panel systems and more particularly, to an improved support leg or strut assembly readily attachable to a support post of the partition assembly and engageable with the floor beneath to provide lateral stability.

The open space concept in office buildings and other similar environments has become quite popular recently. With such construction, individual offices or work areas are often provided by the installation of partition or panel systems comprising one or more panels disposed in either a straight line and/or a right angular configuration. For the most part these partitions extend upwardly little more than eye level and thus must be supported and stabilized along only the bottom and side edges of the partition panels. Quite often the partition system is free-standing, thus deriving its sole support and stability from the underlying floor and even when one side edge of the partition assembly is affixed to a stationary wall of the building enclosure, the remaining free end of the assembly may be devoid of adequate stabilizing means.

From the above it will be appreciated that not only does a safety problem exist should a worker in the area of the partition system bump into or fall against an inadequately stablized portion of the partition but also it will be understood that the usefullness of the system panels for the attachment thereto of additional structure such as shelving and bookcases, would be significantly restricted if sufficient lateral rigidity were lacking.

The improved strut assembly of the present invention is intended to provide means readily attachable to partition systems having various configurations, including those utilizing both square and round supporting posts at the end edges of the panels. A substantially L-shaped strut is provided having an upright captively retained within the internal cavity of a housing or cover while lock means carried by the cover and engaging the strut upright is accessible for actuation from without the assembly to allow raising or lowering of the strut. Adjustment of the strut is accomplished while the overlying cover remains fixedly disposed relative an adjacent panel supporting post and prior to the subsequent tightening of included lock means to rigidly secure the strut at a selected elevation with respect to the balance of the partition system.

The same strut and housing components of the present invention are readily adaptable for attachment to partition systems utilizing either square or round supporting posts. In the case of square posts, the strut-containing housing is clamped directly to one flat wall of the post and retained in a fixed position relative thereto by the lock means which serves to secure the adjustable strut in its selected elevation, while in the case of a round post, the same strut assembly engages and is fixedly retained in abutment with a separate hanger member, the latter of which includes a plurality of hooks which straddle the round post and in turn are disposed within the slots formed in the panel edge channels which serve to attach the ends of two panels to the supporting post.

Many prior attempts have been made to provide laterally extending support legs or struts for partition systems. In many of these instances, either a multitude of components have been required or on the other hand, there has been a total lack of adaptability for use of the leg member with both square and round posts. Additionally, it was often necessary to at least partially disassemble the structure prior to making any adjustment of the elevation of the strut or leg member. U.S. Pat. No. 3,674,230 issued to Propst on July 4, 1972 discloses an example of a substantially L-shaped support leg or strut comprising a plurality of components and wherein the strut member remains affixed relative the partition support post during adjustment of the latter and subsequent adjustment between the strut and the floor is achieved by manipulation of a screw-mounted glide at the end of the strut. U.S. Pat. No. 3,213,580 issued Oct. 26, 1965 to Mark illustrates a panel partition system with L-shaped stabilizing members affixed to the lower portion of a supporting post and which includes a housing or cover adapted to overlie the support leg. In this instance the cover merely masks the already attached and locked support leg and subsequent adjustment of the latter support cannot be made until the separate cover member is removed free and clear of the balance of the assembly.

Accordingly, one of the objects of the present invention is to provide an improved partition strut assembly for a partition system including an L-shaped strut having an upright disposed within the confines of a housing and retained therein by lock means passing therethrough.

A further object of the present invention is to provide an improved partition strut assembly for a partition system having a post, including a housing having a strut upright captively retained therein by lock means passing through and with an exposed opening in one wall of the housing to permit actuation of the lock means for the selective vertical displacement of the upright while the housing remains fixed relative the post.

Still another object of the present invention is to provide an improved partition strut assembly for the removable attachment to a square support post and including a housing containing a vertically displaceable strut upright and wherein the housing is provided with a pair of rearwardly directed flanges engageable with opposite sides of the post to vertical orient and retain the housing with respect to the post.

A further object of the present invention is to provide an improved partition strut assembly including a housing slidably containing therein a slotted strut upright and with lock means passing through the upright slot and journaled within a hole in the rear wall of the housing while manipulation of the fixedly located lock means is provided by means of an access opening in the front wall of the housing.

Another object of the present invention is to provide an improved strut assembly for removable attachment to a partition system having a pair of panel edge channels on opposite sides of a round support post and provided with vertically spaced slots therein with a hanger member overlying the posts and engaging the slots in the two edge channels to serve as support means for the attachment of a housing containing the vertical upright of an angled strut member.

With these and other objects in view which will more readily appear as the nature of the invention is better understood the present invention consists in the novel construction, combination and arrangement of parts hereinafter more fully described, illustrated and claimed.

A preferred and practical embodiment of the invention is shown in the accompanying drawings in which, FIG. 1 is a partially exploded perspective view illustrating a strut assembly according to the present invention.

FIG. 2 is an enlarged fragmentary end elevation of the structure shown in FIG. 1.

FIG. 3 is a horizontal cross section taken along the line 3—3 of FIG. 2 with the addition of a panel edge channel on the near side.

Similar reference characters designate corresponding parts throughout the several figures of the drawings.

Figure 4:
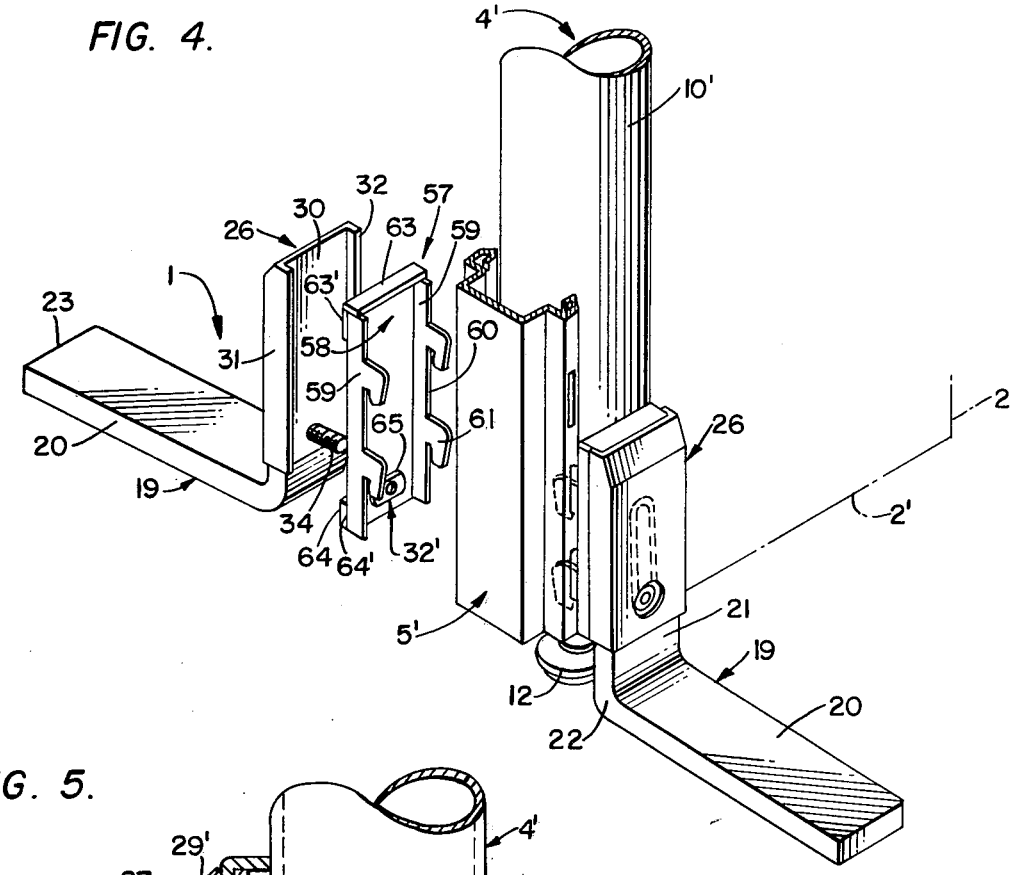
FIG. 4 is a perspective view similar to that of FIG. 1 and illustrates an adaptation of the subject strut assembly for attachment to a partition system including round support posts.

Referring now to the drawings, particularly FIG. 1, the present invention will be understood to provide an improved strut assembly generally designated 1, adapted to provide support and lateral stability when attached to a partition system P. The partition system may include components well known to those experienced in the art, such as one or more panels 2 each having opposite end walls 3 suitably attached to a vertical standard or support post 4 by means of an intermediate edge channel 5. In this embodiment a square post 4 is employed, having a plurality of flat walls.

As most commonly employed, the edge channel 5 is provided with side walls 6 defining a width substantially less in the thickness of the attached panel 2 and serves as the means by which a panel is rigidly affixed to the post 4 which attachment is accomplished by any suitable means (not shown) associated with the edge channel such as lugs, hooks or other fastener devices. The referenced edge channel side walls 6 may be provided with a plurality of vertically aligned, equi-spaced slots 7 accessible through the space or recess 8 defined by the panel end wall 3 and oppositely disposed side wall 9 of the post 4. For simplicity purposes a single panel 2, edge channel 5 and attached post 4 are illustrated in the drawings yet it will be appreciated that a completed partition system P may include any number of panels 2 provided with a respective post 4 attached adjacent both end walls 3 thereof with the panels 2 being disposed in either a straight line or at right angles to the next adjacent panel. Each support post 4 preferably retains the attached panels 2 with their bottom edges 2' disposed slightly above the underlying supporting surface or floor 11 and in order to provide for levelling of the total assembly of panels 2 and to accommodate irregularity in the configuration of the floor surface 11, each post 4 is provided with a suitable glide generally designated 12 mounted upon the bottom of an adjusting screw 13. The glide adjusting screw 13 may be disposed through a bottom wall formed on the post or alternately, as illustrated in the drawings, the screw may be journaled through the bottom 14 of a cup 15 suitably affixed adjacent the bottom open end of the uppport post 4.

As shown most clearly in FIG. 1 of the drawings, the cup 15 is provided with a side wall 16 terminating short of a plurality of horizontal slots or openings 17 formed in each of the post side walls 9 as well as the two outer walls 10. Many existing partition systems are already provided with similar openings adjacent the bottom 18 of the support post and often those openings 17 on the side walls 9 of the post serve to receive the attachment means associated with the panel edge channels 5 for accomplishing the unitary attachment of the panels to the post. In the present instance the openings 17 on the post outer walls 10 will be utilized for the attachment, adjustment and locking of the strut assembly.

Each struct assembly 1 includes a strut 19 preferably constructed of bar stock of substantially inherent rigidity and which is formed to define a substantially L-shaped configuration as provided by the foot 20 and integral upright 21. From an examination of FIG. 2 of the drawings it will be observed that the upright 21 is adapted to be disposed in a vertical plane while the foot 20, although generally disposed horizontally, actually is slightly inclined downwardly from the juncture 22 to its free end 23. With this arrangement, and when the environment incorporates a substantially smooth and level supporting surface or floor 11, only the contact portion 24 of the foot undersurface 25 adjacent the end 23 will be in direct engagement with the floor 11, thereby providing obvious improved stability in view of the distance between the contact portion 24 and the glide 12.

The second principal component of the strut assembly 1 comprises the cover or housing, generally designated 26, having an internal cavity 27 within which the strut upright 21 is substantially fully disposed through the open bottom end 28 thereof. The horizontal dimensions of the cavity 27 are configured to provide a close sliding fit of the strut upright 21 therewithin as shown most clearly in FIG. 3 of the drawings, while the vertical extent of the cavity 27 is formed to permit acceptance of substantially the full vertical extent of the upright 21 as shown in FIG. 2 of the drawings.

The housing 26 is readily constructed of flat plates of thin metal or plastic to provide a front wall 29 joined to a parallel rear wall 30 by means of a pair of side walls 31, the latter of which extend rearwardly beyond the vertical plane of the housing rear wall 30 to form a pair of rearwardly projecting flanges 32. By providing the strut upright 21 of a width substantially corresponding to the width of the post outer walls 10 it will follow that the housing side walls 31 will extend slightly beyond the width of the post wall 10 so that the housing flanges 32 will engage the two adjacent post side walls 9 to provide the mating fit as shown in FIG. 3 of the drawings. The foregoing construction will be seen to ensure lateral stability of the housing 26 when assemblied in relation to the support post 4 as shown in the right hand portion of FIG. 1 of the drawings.

The above attachment is achieved by strut lock means 32' normally an integral part of the assembly 1 as shown in the left hand portion of FIG. 1 of the drawings. The lock means 32' includes a suitable threaded fastener such as the bolt 33 having its shank 34 disposed through a vertical slot 35 formed in the medial portion of the strut upright 21. The bolt head 36, which is provided with a suitable tool slot or socket 37, will be seen to be fully disposed within a counter bore 38 associated with the strut upright slot 35. The shank 34 of the bolt is freely journaled through a close fitting opening 39 formed in the lower portion of the housing rear wall 30 and extends therebeyond a substantial distance. Threadedly disposed upon this extension of the shank 34 is a nut member such as the nut bar 40 comprising an elongated plate having either its length or width of a greater dimension than the corresponding dimension of the slots 17 provided in the post 4. In the case of the illustrated embodiment as shown most clearly in FIG. 1 of the drawings, the height of the nut bar 40 is no greater than the height of the slot 17 yet the length thereof will be seen to be slightly greater than the corresponding dimension of the slot 17. With the foregoing arrangement in mind and upon consideration of the left hand strut assembly shown in FIG. 1 it will be appreciated that attachment of the strut assembly to the juxtaposed post outer wall 10 may be readily accomplished by slightly canting the rear wall 30 of the housing as it approaches the post outer wall and initially inserting only one end of the nut bar through the juxtaposed slot 17, thereafter slightly laterally shifting the strut assembly in the direction of the inserted nut bar end and thereafter moving the strut assembly closer to the post to insert the balance of the nut bar into the interior 41 of the post 4. Following the preceding steps, the positioned strut assembly 1 is securely attached relative the partition system P upon manipulation of the lock means 32' to cause clamping together of all of the components as they become sandwiched between the head 36 and nut bar of the lock means. This action is accomplished by the insertion of a suitable tool through an access opening 42 formed in the housing front wall 29 and when completed the rigid assembly will appear as shown in the right hand portion of FIG. 1. To preclude accidental separation of the components of the lock means 32' during manipulation of the bolt 33, the bolt shank 34 is preferably staked as at 34' adjacent its end.

Following attachment of the strut assembly 1 as described above, the selective adjustment of the strut 19 is readily achieved without removal of the housing 26 from its stabilized position in engagement with the post 4. The lock means bolt is merely loosened a slight degree to release the clamping force being applied by its head 36 and the lock bar 40, following which the strut 19 may be moved vertically to any point defined by the limits of the upright slot 35. The adjustment as shown in FIG. 2 of the drawings is an example of the relationship of the components as they would appear when the strut 19 is positioned at its maximum height. In this postion it will be seen that the top or free end 43 of the strut upright 21 is disposed in the uppermost portion of the housing cavity 27 immediately beneath the housing top wall 29' as the bottommost portion of the strut upright slot 35 is engaging the bolt shank 34. On the other hand, the relative positions illustrated in the right hand portion of FIG. 1 of the drawings reflects the strut assembly 1 as it would appear when partially lowered to thereby provide a substantial elevation of the balance of the partition system P relative the underlying supporing surface or floor 11. Whenever adjustment of the support provided by the strut assembly 1 is carried out, the glide 12 is likewise manipulated to re-position its screw shaft 13 so that the principal weight of the adjacent portion of the partition system P is carried thereby while the properly positioned foot portions 20 of the strut assemblies are situated to firmly abut the contact portion 24 thereof with the floor 11 to ensure maximum lateral stability of the partition system P.

Figure 5:
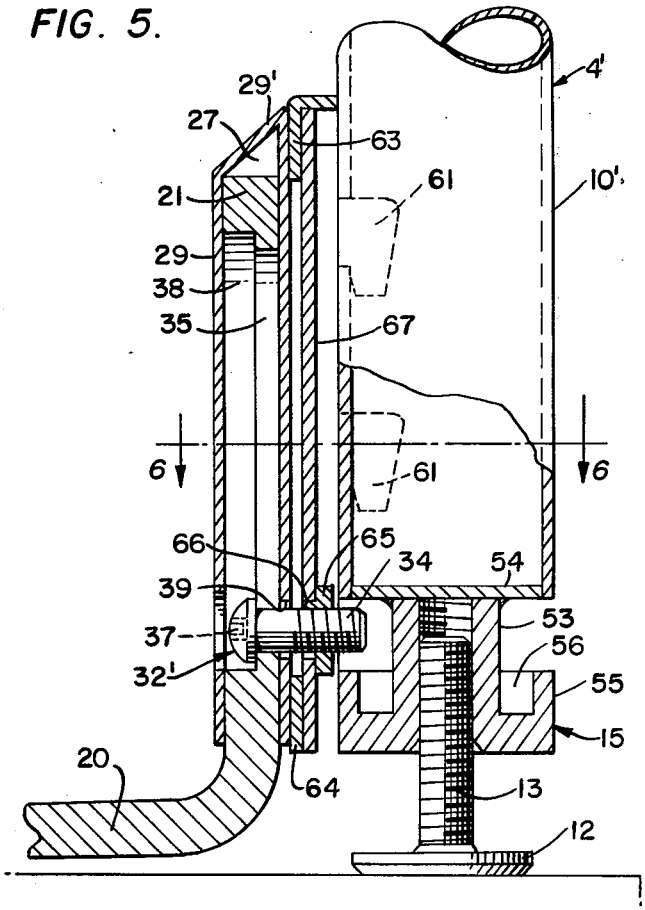
FIG. 5 is an end elevation, partly in section, of the embodiment shown in FIG. 4.
Figure 6:
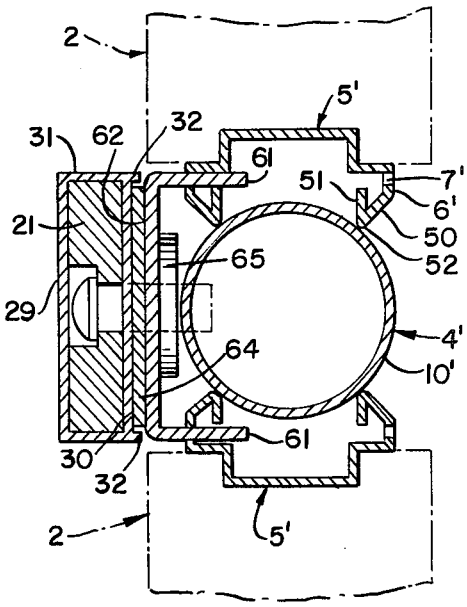
FIG. 6 is a horizontal section view taken on the line 6—6 of FIG. 5.

FIGS. 4–6 of the drawings illustrate an alternate embodiment involving a partition system P' employing one or more panels 2 similar to the first described embodiment but wherein the supporting standards comprise a round or cylindrical post 4' instead of the square post 4 as in the embodiment shown in FIGS. 1–3. The alternative provision of square or round supporting posts in partition systems is well known and requires a slightly modified panel edge channel and manner of securing the edge channel to the post. The diameter of the round post 4' is preferably smaller than the thickness or width of the panels 2 as shown in FIG. 6 of the drawings and accordingly, the edge channel 5' includes a pair of inwardly inclined walls 50 projecting from the side walls 6' with each terminating in an inturned flange 51 to provide an exposed vertical nose 52 engageable with the cylindrical outer perpihery 10' of the round post.

The primary vertical support along the center line of the partition system P' may be provided by the same earlier described type of glide 12 which in this case is suitably attached for vertical adjustment by means of a post mounting cup 15' having a central stem 53 affixed to a post bottom wall 54 as shown in FIG. 5 of the drawings. An upstanding rim 55 on the mounting cup 15' is spaced from the stem 53 to form a cylindrical groove 56 for the reception of any well known form of mounting clip (not shown) carried by the edge channels 5' for the purpose of hanging or attaching the panels 2 to the supporting posts 4'.

The strut assembly 1 as previously described in connection with the embodiment of FIGS. 1–3 of the drawings is readily adapted for attachment to the round post modification of FIGS. 4–6 by the provision of an intermediate hanger member, generally designated 57. This hanger member 57 is intended to overlie and straddle the outer periphery 10' of the round post 4' and to offer a stationary base for the reception and attachment thereto of the strut assembly 1. The hanger member includes a hanger plate 58 of a width greater than the diameter of the round post 4' and provided with a pair rearwardly projecting side walls 59–59 each having an inner edge 60 from which further projects rearwardly a pair of hooks 61 as shown most clearly in FIG. 4 of the drawings. Affixed to the outer surface 62 of the hanger plate 58 is an upper plate 63 and a lower plate 64, each having their side edges 63' and 64' respectively, laterally defining an included dimension which is slightly less than the dimension between the pair of rearwardly projecting flanges 32—32 of the strut assembly cover 26.

The hanger member 57 is readily affixed to a standing partition system P' by the insertion of the respective pairs of hooks 61 into the available slots 7' formed in the side walls 6' of two edge channels 5' abutting a single round post 4' and when thus positioned, such as shown in FIG. 6 of the drawings, the outer surface 62 of the hanger member plate 58 will be seen to be disposed substantially co-planar with respect to the face F of the adjacent panels 2. The strut assembly 1 may now be rigidly attached relative the balance of the partition system by means of its bolt 33 which is intended to cooperate with nut means in the form of weld nut 65 rigidly secured to the hanger member plate 58 and in alignment with a suitable hole 66 formed therethrough. When thus affixed to the hanger member 57 the strut assembly 1 will appear as shown in the right hand portion of FIG. 4 and FIGS. 5 and 6 of the drawings wherein it will be seen that when the bolt 33 is tightened the two rearwardly projecting flanges 32—32 of the strut assembly housing 26 straddle the hanger member upper plate 63 and lower plate 64 as the inner surface 67 of the hanger plate 58 is drawn tightly into engagement with both the upper plate 63 and lower plate 64.

Manipulation of the strut 19 of the strut assembly 1 in this second embodiment is accomplished in an identical manner to that as described in connection with the embodiment of FIGS. 1–3 of the drawings to allow variable vertical positioning of the strut upright 21 and foot 20 within the limits as defined by the length of the upright slot 35 and as restricted by the relatively stationary bolt 33.

From the foregoing, it will be appreciated that a unique adjustable strut assembly has been provided which may alternately be affixed to square or round posts in a partition system and readily adjusted by means of no more than a single tool such as a socket wrench or screwdriver which serves to loosen and tighten lock means carried by the strut assembly.

In the case of the round post environment, attachment of the same strut assembly is made possible by use of lock means including an intermediate hanger member.

We claim:

1. A partition strut assembly adapted for attachment adjacent a vertical post having an outer wall and disposed above a support surface including, a strut having an upright joined to a substantially horizontal foot, said upright provided with a vertically extending slot therethrough, a housing including front, rear and side walls defining a bottom opening leading to an internal vertically disposed cavity, said housing rear wall having a hole aligned with an access opening in said housing front wall, said strut upright slidably disposed within said housing cavity with said slot aligned between said housing hole and access opening, lock means retaining said housing with its said rear wall facing said post outer wall, and said lock means including a fastener bolt having a hank passing through said slot thence extending rearwardly through said housing hole and engageable with means disposed stationary relative said vertical post to fixedly attach said housing adjacent thereto whereby, said lock means maintains said housing vertically fixed relative said post and retains at least a portion of said strut upright captively disposed within said housing cavity while allowing of vertical displacement of said strut within the limits as defined by said slot surrounding said fastener bolt shank.

2. A partition strut assembly according to claim 1 wherein, said post is rectangular and includes a pair of said outer walls, said housing rear wall engageable with one said post wall, and said stationary means includes an opening in at least one said post outer wall and receiving said fastener bolt shank.

3. A partition strut assembly according to claim 1 wherein, said strut foot includes a free end disposed slightly below the remainder of said foot whereby, the undersurface of said foot provides a contact portion adjacent said free end for initial engagement with the support surface when said strut is lowered.

4. A partition strut assembly according to claim 1 wherein said housing cavity is of a vertical extent sufficient to accept substantially all of said strut upright therein.

5. A partition strut assembly according to claim 1 wherein, said post is round and said outer wall is cylindrical, a pair of panels adjacent said post outer wall, an edge channel intermediate each said panel and said post periphery, a hanger member spanning said post between said edge channels, attachment means removably joining said hanger member to said edge channels, and said hanger member is disposed intermediate said housing and post.

6. A partition strut assembly according to claim 1 wherein, said strut upright slot includes a counterbore, said bolt having a head disposed within said counterbore, and tool-receiving means on said head accessible through said housing front wall access opening.

7. A partition strut assembly according to claim 1 wherein, said post is rectangular and includes a pair of said outer walls, said housing rear wall engageable with one said post wall, a nut bar carried on said bolt shank, and said stationary means includes an opening in said post wall receiving said nut bar.

8. A partition strut assembly according to claim 1 wherein, said housing side walls extend beyond said rear wall and define a pair of rearwardly projecting flanges.

9. A partition strut assembly according to claim 2 wherein, said post includes side walls intermediate said outer walls, said housing side walls extending beyond said rear wall and defining a pair of rearwardly projecting flanges, and said housing rear wall is substantially as wide as each said post outer wall whereby, when said rear wall is juxtaposed one said outer wall said two flanges closely engage said two post side walls.

10. A partition strut assembly according to claim 4 wherein, said housing cavity and strut upright are rectangular in cross-section and define a close mating fit between one another.

11. A partition strut assembly according to claim 5 wherein, said edge channels each include side walls provided with slots, said hanger member including a plate having two rearwardly projecting side walls, and at least one hook projecting rearwardly from each said hanger member side wall and engageable in respective slots in said two edge channels.

12. A partition strut assembly according to claim 11 wherein, said stationary means includes a hole in said hanger member plate receiving said fastener bolt shank.

* * * * *